US005335821A

United States Patent [19]

Osgar

[11] Patent Number: 5,335,821

[45] Date of Patent: Aug. 9, 1994

[54] LIQUID CHEMICAL CONTAINER AND DISPENSING SYSTEM

[75] Inventor: Michael L. Osgar, Eagan, Minn.

[73] Assignee: NOW Technologies, Inc., Bloomington, Minn.

[21] Appl. No.: 943,900

[22] Filed: Sep. 11, 1992

[51] Int. Cl.[5] ..... B67D 5/54

[52] U.S. Cl. ..... 222/83; 222/91; 222/105; 222/400.7

[58] Field of Search ..... 222/83, 83.5, 88, 91, 222/95, 105, 400.7, 464

[56] References Cited

U.S. PATENT DOCUMENTS

| | | | |
|---|---|---|---|
| Re. 27,626 | 4/1973 | Johnston | 222/400.7 |
| 2,453,080 | 11/1948 | Shimp | 222/185 |
| 3,239,104 | 3/1966 | Scholle | 222/89 |
| 3,342,377 | 9/1967 | Peredy | 222/95 X |
| 3,357,602 | 12/1967 | Sichler | 222/400.7 |
| 3,397,620 | 8/1968 | Skelton | 92/24 |
| 3,467,283 | 9/1969 | Kinnavy | 222/95 |
| 3,777,925 | 12/1973 | Eckholm | 220/404 |
| 3,828,977 | 8/1974 | Borchert | 222/95 |
| 3,883,046 | 5/1975 | Thompson et al. | 222/95 |
| 3,945,534 | 3/1976 | Ady | 222/400.7 |
| 3,952,918 | 4/1976 | Poitras et al. | 222/82 |
| 4,011,288 | 3/1977 | Assenheimer et al. | 222/83.5 X |
| 4,089,443 | 5/1978 | Zrinyl | 222/386.5 |
| 4,147,278 | 4/1979 | Uhlig | 222/400.8 |
| 4,165,023 | 8/1979 | Schmitt | 222/105 |
| 4,171,757 | 10/1979 | Diamond | 222/389 |
| 4,265,374 | 5/1981 | Sebalos | 222/95 |
| 4,271,991 | 6/1981 | Diamond | 222/389 |
| 4,308,973 | 1/1982 | Irland | 220/454 |
| 4,330,066 | 5/1982 | Berliner | 215/1 C |
| 4,445,550 | 5/1984 | Davis et al. | 222/105 |
| 4,452,378 | 6/1984 | Christine | 222/107 |
| 4,457,455 | 7/1984 | Meshberg | 222/105 |
| 4,491,247 | 1/1985 | Nitchman et al. | 222/131 |
| 4,562,942 | 1/1986 | Diamond | 222/386.5 |
| 4,641,765 | 2/1987 | Diamond | 222/386.5 |
| 4,756,347 | 7/1988 | Hagan et al. | 222/400.7 |
| 4,785,973 | 11/1988 | Kobe | 222/400.7 X |
| 4,804,065 | 2/1989 | Scragg | 222/94 |
| 4,892,230 | 1/1990 | Lynn, Jr. | 222/105 |
| 5,102,010 | 4/1992 | Osgar et al. | 222/1 |
| 5,205,440 | 4/1993 | Matsushita | 222/95 X |

FOREIGN PATENT DOCUMENTS

| | | | |
|---|---|---|---|
| 8502184 | 3/1987 | Netherlands | 222/400.7 |
| WO82/00780 | 3/1982 | PCT Int'l Appl. | 222/105 |
| 762567 | 11/1956 | United Kingdom . | |

*Primary Examiner*—Andres Kashnikow
*Assistant Examiner*—Kenneth Bomberg
*Attorney, Agent, or Firm*—Kinney & Lange

[57] ABSTRACT

A container for storage, transport, and dispensing of liquid chemicals includes a fluid container having a port, a dip tube having a fluid passage from an upper end to a lower end of the dip tube, a dip tube coupling at the upper end of the dip tube for insertion into the port, and a rupturable membrane sealed over a top end of the port. The dip tube coupling has a cavity in its upper end and a fluid passage connecting the cavity with the fluid passage of the dip tube. The dip tube coupling defines a gas passage extending from an interior of the fluid container to the cavity. A rupturable membrane is positioned over a top end of the port to seal the cavity, so that when the rupturable membrane is punctured or removed, gas from the fluid container, which has accumulated in the cavity, is permitted to escape. To remove the liquid chemical, the cap is removed to expose the rupturable membrane. A probe is next inserted through the membrane to allow gas to escape, and into the cavity, whereby the probe, upon insertion into the cavity, causes the gas passage to be blocked. Liquid is dispensed from the fluid container through a fluid passage within the dip tube and through a flow passage within the probe.

31 Claims, 7 Drawing Sheets 12
14
46
150
18
76
124
24
80
94
162
142
144
104
87
72
62
52
90
50
20

LIQUID CHEMICAL CONTAINER AND DISPENSING SYSTEM

BACKGROUND OF THE INVENTION

The invention relates to containers for storage, transport and use of liquid chemicals including acids, solvents, bases, photo-resists, dopants, inorganics, organics, biological solutions, pharmaceuticals, and radioactive chemicals. In particular, the invention relates to a container which uses a dip tube, and to dispensing systems used in conjunction with this container.

A dip tube allows for safe dispensing of a liquid chemical from larger sized containers having capacities greater than one gallon. The use of a dip tube permits the container to be kept upright while the liquid chemical is dispensed from the container. Dip tubes have been commonly used to insure that the complete contents of the container have been emptied. However, in order to assure that the contamination is kept to a minimum, it would be desirable to install the dip tube immediately after the container is filled with the liquid chemical. Because dangerous drips and spills occur when the dip tube is removed, it is not practical to extract a long dip tube from one container to insert it in another container. Consequently, once the dip tube is installed, it should not be removed until all the liquid is dispensed.

If the dip tube is in place from immediately after filling the container, problems may arise when the liquid chemical is dispensed. During shipping and handling, vapor pressure is generated inside the container. If the container is not properly vented, the chemical vapor pressure will force the liquid chemical up the dip tube upon removal of the cap or seal used during shipment to cover the upper end of the dip tube. As a result, a vapor pressure build up can cause dangerous liquid chemical spills. To prevent these spills, chemical vapor pressure buildup must be vented before liquid chemical is dispersed. Consequently, liquid chemical containers using dip tubes are required to have an additional mouth or port to permit the venting of vapor pressure buildup before dispensing liquid chemical through the dip tube.

Before the employment of double containment containers for liquid chemicals, liquid chemicals were dispensed from containers by either pumping the liquid chemicals out or by placing the container in a pressure vessel to force liquid chemicals out to a dispense point.

To allow for direct pressurization of the shipping containers and to enable complete reuse of the containers, the containers were usually constructed of more substantial materials. The containers consisted of formed and welded metallic vessels, typically stainless steel, certified to specified transportation regulations. However, this system had several drawbacks. With certain chemicals, contact with a metallic container caused ionic contamination. In addition, removal of submicron particulate inside the container was extremely difficult. These particulates ended up in the liquid chemical and affected the purity of the liquid chemical. In addition, the handling logistics of returning the empty container to the chemical supplier for refilling was problematic. To avoid the possibility of cross-contamination, a specific container had to be dedicated to a specific chemical and to a specific user.

An additional feature which presently solves these problems is the use of a double containment container having a pre-cleaned, flexible film bag, constructed of inert materials and placed within an outer container.

After the liquid chemicals have been dispensed from the film bag, the film bag can be easily disposed of. By inserting a fresh, pre-cleaned bag in the existing outer container, contamination, logistics, reuse and environmental issues are addressed. See U.S. Pat. No. 5,102,010 to Osgar et al. issued on Apr. 7, 1992, which is assigned to NOW Technologies, Inc.

SUMMARY OF THE INVENTION

The present invention is a container for liquid chemicals having a single port which contains a dip tube which vents chemical vapor pressure buildup. In a preferred embodiment, the container includes an outer container having a mouth; a fitment for mounting in the mouth; an inert, corrosion-resistant, flexible bag mounted to the lower end of the fitment and positioned within an interior of the outer container; a dip tube having a fluid passage from an upper end to a lower end of the dip tube; a dip tube coupling at the upper end of the dip tube for insertion into the fitment; and a rupturable membrane sealed over the top end of the fitment. The dip tube coupling has a cavity in its upper end and defines a gas passage which extends from an interior of the bag to the cavity. In addition, a cap may be mounted over the mouth of the bottle to cover the rupturable membrane.

When the bag has been placed within the interior of the outer container and the bag's attached fitment has been mounted in the mouth of the outer container, the bag is preferably expanded with nitrogen or compressed air before filling. Afterward, the bag is filled with liquid chemicals through the fitment. The dip tube and the dip tube coupling are then inserted through the fitment. The rupturable membrane is placed over a top end of the fitment to seal the cavity. In addition, a cap may be placed over the mouth of the bottle to cover the rupturable membrane. During shipping and handling, any gas that is generated in the flexible bag may flow through the gas passage defined by the dip tube coupling to accumulate in the cavity at the upper end of the dip tube coupling.

To dispense the liquid chemical, the cap is removed and a probe is inserted through the membrane to permit gas from the interior of the bag which has accumulated in the cavity to escape. Upon full insertion of the probe into the cavity, the gas passage is blocked. The liquid chemical is then dispensed from the bag through the fluid passage of the dip tube and through a flow passage in the probe.

In one embodiment of the present invention, the dip tube coupling defines a gas passage by using a spacing element positioned between the dip tube coupling and the fitment. The spacing element spaces apart the dip tube coupling and the fitment to provide a gas passage extending from the interior of the flexible bag, between an outer surface of the dip tube coupling and an inner surface of the fitment, to the cavity of the dip tube coupling. The spacing element is comprised of an annular ring integral to the outer surface of the dip tube coupling. The annular ring has a notch to permit gas to flow past the annular ring.

In another embodiment of the present invention, the dip tube coupling defines a gas passage which extends from the interior of the flexible bag, through the dip tube coupling, to the cavity of the dip tube coupling.

DETAILED DESCRIPTION OF THE PREFERRED EMBODIMENTS

Figure 1:
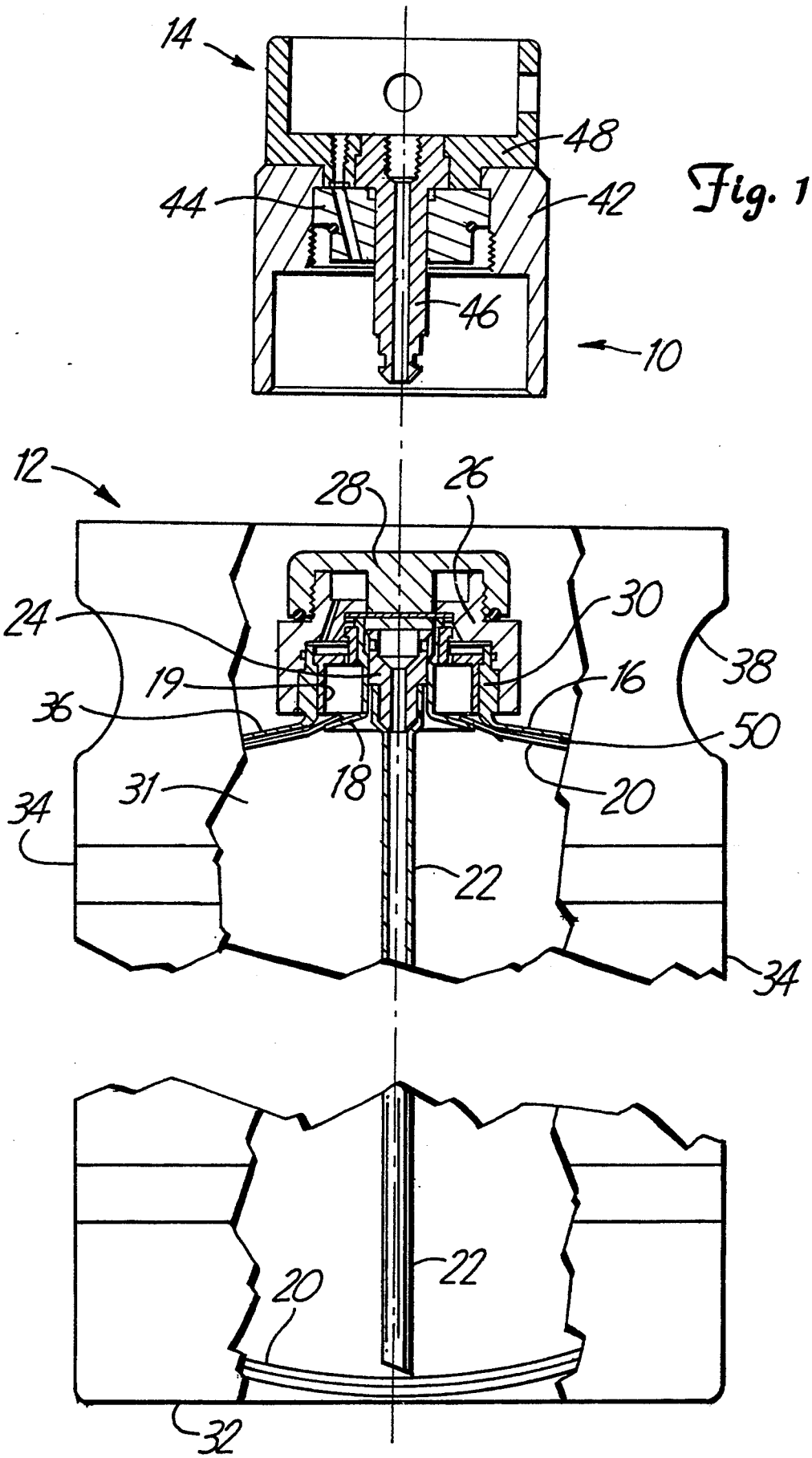
FIG. 1 is a sectional view of a double containment liquid chemical handling system of the present invention.

FIG. 1 shows a preferred embodiment of a double-containment liquid chemical handling system 10 which includes container 12 and dispenser 14. Container 12 includes outer container 16, fitment 18, retainer 19, flexible bag 20, dip tube 22, coupling 24, closure 26, rupturable membrane 27, and cap 28.

Outer container 16 has externally threaded mouth 30 in which retainer 19 and fitment 18 are mounted. Flexible bag 20 is attached to fitment 18 and is located within outer container 16. Dip tube coupling 24 rests within fitment 18 and is coupled to dip tube 22, which extends down into interior 31 of flexible bag 20. Closure 26 encloses fitment 18, dip tube coupling 24, and mouth 30 of outer container 16 while sealing fitment 18 and outer container 16 with rupturable membrane 27. Cap 28 is screwed on top of closure 26.

Outer container 16 provides the mechanical support and protection required by flexible bag 20 during filling, transport, handling, and dispensing. Outer container 16 is typically constructed of metal, although other materials, including plastic materials, may also be used, depending upon government regulatory specifications for handling of the particular liquid chemical to be contained within container 12. Outer container 16 is generally a steel drum having bottom 32, sidewall 34, sloped top 36, externally threaded mouth 30, and formed handle 38. Sloped top 36 is inset below an upper edge of sidewall 34. Sidewall 34 of outer container 16 protects cap 28, closure 26, and mouth 30 of container 12.

Fitment 18 is mounted to mouth 30 of outer container 16 by retainer 19 and upholds flexible bag 20 within outer container 16. During filling, bag 20 is first inflated with a gas such as nitrogen and liquid chemical is then supplied through fitment 18 to fill flexible bag 20 within outer container 16. After bag 20 is filled, dip tube 22 and dip tube coupling 24 are inserted into fitment 18. Dip tube coupling 24 rests within fitment 18 and supports dip tube 22 within flexible bag 20. Dip tube 22 permits container 12 to be kept upright while liquid chemical is dispensed from container 12. Dip tube 22 also insures that the complete contents of container 12 are emptied. Consequently, dip tube 22 allows for safe dispensing of liquid chemical from large containers, (e.g. larger than one gallon capacity). In order to assure that contamination is kept to a minimum, dip tube 22 is installed immediately after flexible bag 20 of container 12 is filled with the liquid chemical. Because dangerous drips and spills can occur when dip tube 22 is removed, dip tube 22 is not removed until after all the liquid is dispensed from container 12.

Closure 26 and rupturable membrane 27 seal fitment 18 while stabilizing and protecting fitment 18 and mouth 30 of outer container 16. Cap 28, meanwhile, covers and protects rupturable membrane 27 during shipping and handling of container 12.

Dispenser 14 includes lower connector 42, retainer 44, probe 46, and upper connector 48. Retainer 44 is nested within lower connector 42. Probe 46 extends through retainer 44 and is supported by retainer 44. Upper connector 48 couples with retainer 44 and lower connector 42 to enclose probe 46.

To dispense liquid chemical from container 12, cap 28 must first be removed. Probe 46 is inserted through rupturable membrane 27 to release gas that has accumulated from liquid chemical within flexible bag 20. As a result, vapor pressure buildup within flexible bag 20 is vented. Probe 46 is then inserted fully into dip tube coupling 24. Pressurized fluid, preferably compressed air or nitrogen, is supplied to compression space 50, located between an inner wall of outer container 16 and an outer surface of flexible bag 20, to force liquid chemical up through dip tube 22, dip tube coupling 24, and probe 46 to a dispense point. Alternatively, a pump connected to probe 46 can withdraw liquid chemical from the container 12. As liquid chemical is withdrawn from flexible bag 20 of container 12, air is permitted to enter compression space 50 thereby collapsing bag 20.

Figure 2:
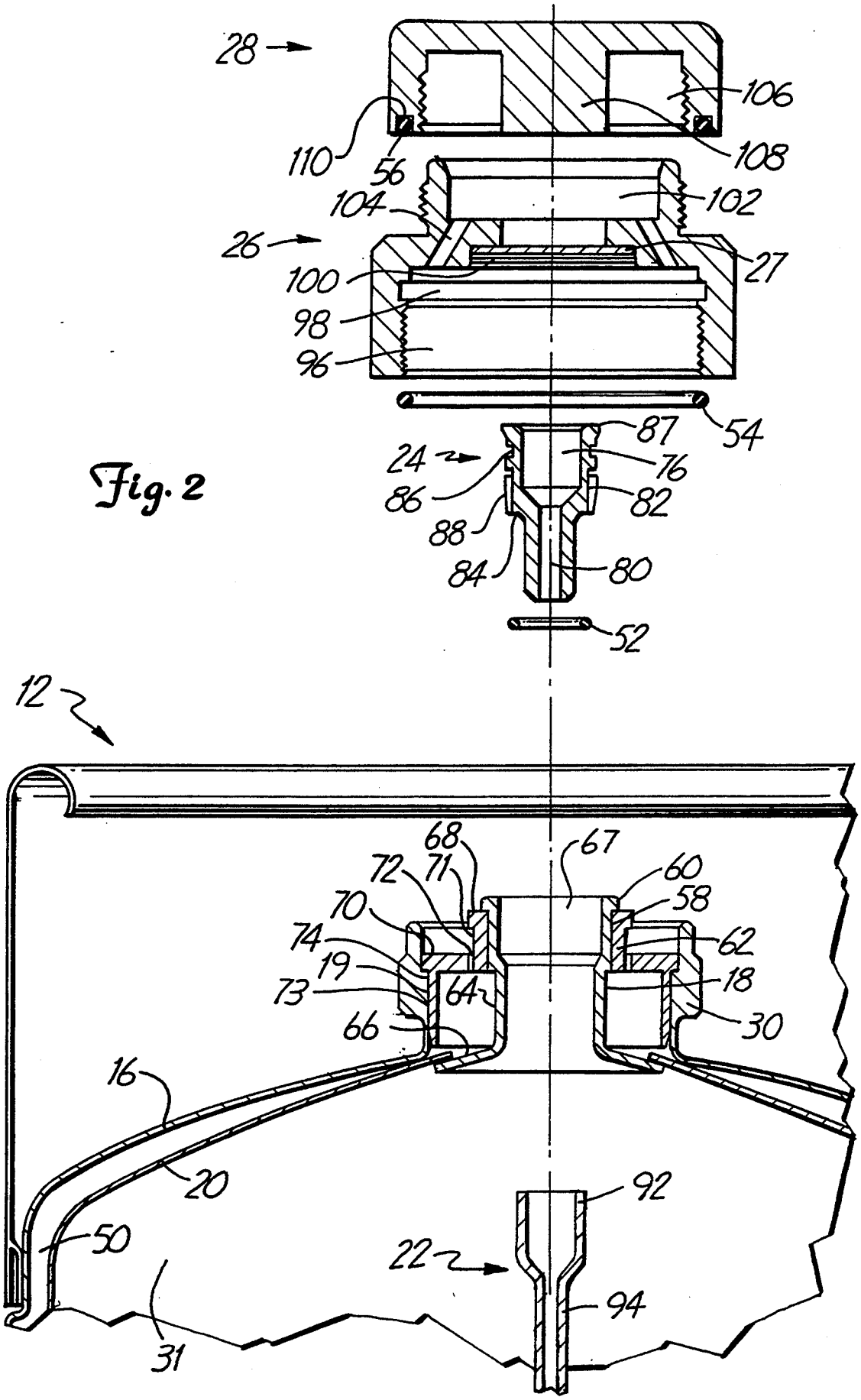
FIG. 2 is an exploded sectional view of a top end of the container and cap of the system of FIG. 1.
Figure 3:
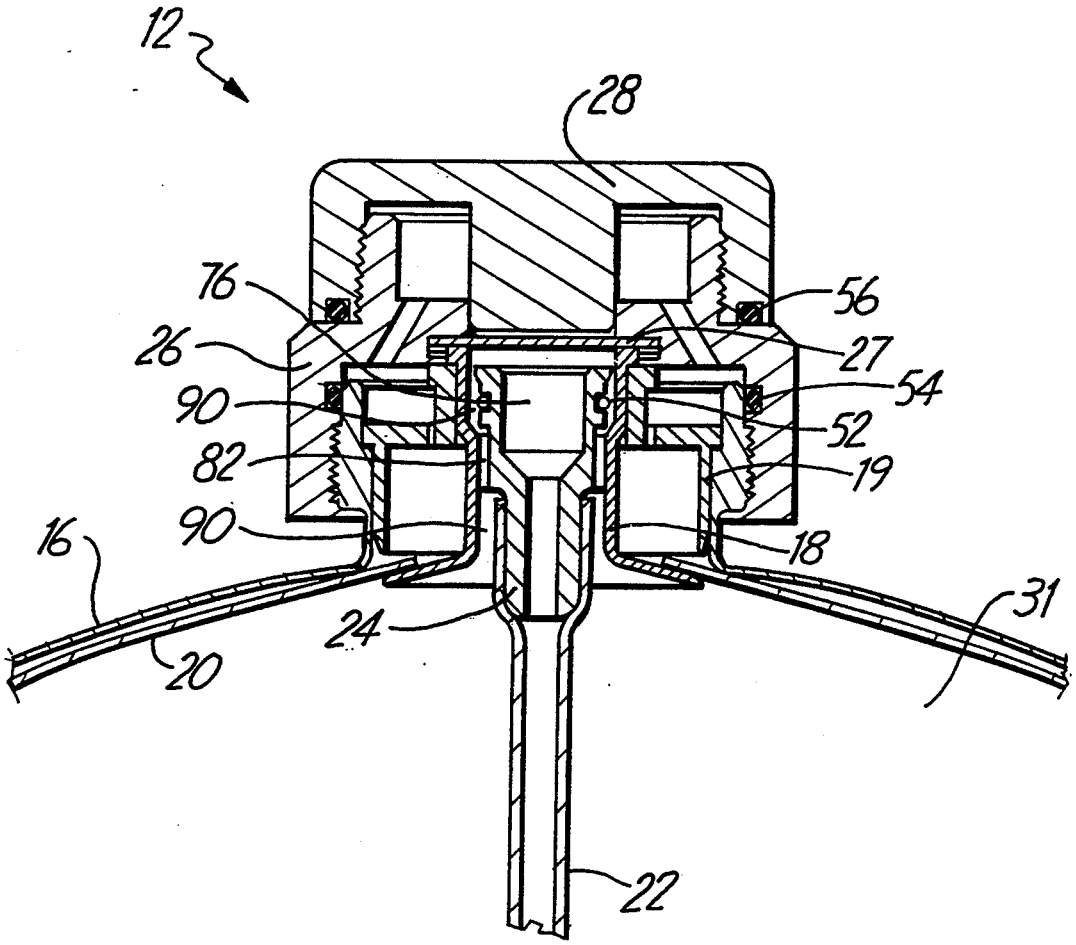
FIG. 3 is a sectional view of the top end of the container of FIGS. 1 and 2 assembled with the cap mounted thereon.

Container 12 is shown in more detail in FIGS. 2 and 3. FIG. 2 shows an exploded sectional view of a top end of container 12 and FIG. 3 shows an assembled sectional view of container 12. As shown in FIGS. 2 and 3, container 12 includes outer container 16, fitment 18, retainer 19, flexible bag 20, dip tube 22, dip tube coupling 24, closure 26, rupturable membrane 27, cap 28, and O-rings 52, 54 and 56.

Fitment 18 includes mouth 58, lip 60, throat 62, neck 64, shoulder 66 and portal 67. Portal 67 extends through fitment 18 and is in communication with interior 31 of flexible bag 20. Lip 60 is located at an upper end of mouth 58 and extends horizontally outward from mouth 58 at a 90° angle. Toward a lower end of mouth 58, fitment 18 narrows to form throat 62. Neck 64 extends from throat 62 down into outer container 16, at which point, fitment 18 extends outward substantially horizontal from neck 64 to form shoulder 66. Shoulder 66 supports flexible bag 20 within outer container 16. Flexible bag 20 is sealed to shoulder 66 such that during filling of flexible bag 20, liquid chemical cannot come in contact with outer container 16. Thus, contamination is avoided.

In one preferred embodiment, retainer 19 is a clam shell type ring joined by a living hinge as shown in U.S. Pat. No. 5,102,010 to Osgar et al. issued on Apr. 7, 1992, which is assigned to NOW Technologies, Inc. Retainer 19 mounts fitment 18 within mouth 30 of outer container 16 and includes brim 68, horizontal ledge 70, side walls 71, support walls 73, and opening 72. Brim 68 is horizontal and extends outward from a top end of side walls 71. Below brim 68, retainer 19 extends vertically, bends at a right angle outward from side walls 71, to form horizontal ledge 70, and bends 90° downward to form support walls 73. An inside diameter of side walls 71 and brim 68 is wider than an outside diameter of mouth 58 of fitment 18. Brim 68 supports fitment 18 below lip 60 of fitment 18. Horizontal ledge 70 rests upon edge 74, located on an inner surface of mouth 30 of outer container 16. Edge 74 supports retainer 19 within mouth 30 of outer container 16. Opening 72, within horizontal ledge 70, is in communication with compression space 50 and permits a fluid to be supplied to compression space 50, thereby collapsing flexible bag 20 and forcing the liquid chemical up through dip tube 22 to dispense liquid chemical. Alternatively, liquid chemical can be pumped out of flexible bag 20 whereby opening 72 vents air to compression space 50.

Dip tube coupling 24 rests within fitment 18. Dip tube coupling 24 includes cavity 76, fluid passage 80, annular ring 82, shoulder 84, groove 86, rim 87 and notch 88. Cavity 76 is centered within dip tube coupling 24 at its upper end and narrows toward a lower end of the cavity to communicate with fluid passage 80. Fluid passage 80 is centered within dip tube coupling 24 and extends from cavity 76 to a lower end of dip tube coupling 24. Annular ring 82 is integral to an outer surface of dip tube coupling 24. Notch 88 extends vertically through annular ring 82. Shoulder 84 is located below annular ring 82 and is formed where the outer surface of dip tube coupling 24 narrows sharply inward. Brim 87 is formed at the upper end of dip tube coupling 24 where the outer surface of dip tube coupling 24 protrudes outward. Groove 86 is in the outer surface of dip tube coupling 24 and is located above annular ring 82 and below brim 87.

Cavity 76 provides a space where gas from interior 31 of flexible bag 20 can accumulate. During the shipping and handling of container 12, annular ring 82 forms a part of gas passage 90 and spaces apart dip tube coupling 24 and fitment 18 to provide gas passage 90, as best shown in FIG. 3, between an outer surface of dip tube coupling 24 and an inner surface of fitment 18, to cavity 76. Notch 88, within annular ring 82, permits gas to flow past annular ring 82 and into cavity 76. Annular ring 82 also upholds dip tube coupling 24 within fitment 18 slightly below throat 62 of fitment 18.

Dip tube 22 is mounted on the lower end of dip tube coupling 24 below shoulder 84. The upper end of dip tube 22 forms funnel 92 and narrows to form tube 94 which extends down into interior 31 of flexible bag 20. An inside diameter of funnel 92 is wider than an outside diameter of dip tube coupling 24 below its shoulder 84. Funnel 92 couples with dip tube coupling 24 such that fluid passage 80 of dip tube coupling 24 is in fluid communication with tube 94 of dip tube 22. During dispensing of the liquid chemical, the liquid chemical is forced up from the bottom of flexible bag 20 through tube 94 and through fluid passage 80 of dip tube coupling 24.

Closure 26 encloses fitment 18, dip tube coupling 24, and mouth 30 of outer container 16, and seals fitment 18 and outer container 16. Closure 26 includes lower bore 96, groove 98, lip spacer 100, rupturable membrane 27, upper bore 102, and compression passage 104. Lower bore 96 is centered within closure 26 at a lower end of closure 26. Lower bore 96 includes internal threads for engaging external threads on mouth 30 of outer container 16. Groove 98 is located toward an upper end of lower bore 96. Lip spacer 100 is located above upper bore 102, has an inside diameter slightly larger than the outside diameter of lip 60 of fitment 18, and has a height equal to the height of lip 60. Rupturable membrane 27 seals across lip spacer 100 and separates lip spacer 100 and lower bore 96 from upper bore 102. Upper bore 102 is centered within a top end of closure 26. The upper end of closure 26 has external threads for engaging internal threads of cap 28. Compression passage 104 extends from upper bore 102, through closure 26, to lower bore 96, bypassing rupturable membrane 27.

When container 12 is assembled, as shown in FIG. 3, compression passage 104 is in fluid communication with opening 72 of retainer 19 and compression space 50. Upon assembly, closure 26 encloses externally threaded mouth 30 of outer container 16. Mouth 30 of outer container 16 screws within lower bore 96. Lip spacer 100 surrounds lip 60 and mouth 58 of fitment 18, while rupturable membrane 27 seals mouth 58 of fitment 18 to trap accumulated gas within fitment 18 and cavity 76 of dip tube coupling 24 until the liquid chemical is dispensed. Rupturable membrane 27 further prevents atmospheric contamination of the contents during shipping and storage. Groove 98 carries O-ring 54, which seals between mouth 30 of outer container 16 and closure 26. Compression passage 104 and opening 72 permit fluid under pressure to be supplied to compression space 50 so that flexible bag 20 can be collapsed and the liquid chemical can be dispensed. Alternatively, compression passage 104 and opening 72 vent air to compression space 50 as liquid chemical is pumped from flexible bag 20.

Screwed to the top end of closure 26 is cap 28 which includes inner cavity 106, protrusion 108, and groove 110. Inner cavity 106 is centered within a lower end of cap 28 and has internal threads for engaging external threads of closure 26. Protrusion 108 extends from the top end of cap 28 into inner cavity 106 and is formed to fit upper bore 102 of closure 26. Groove 110 is located on a bottom surface of cap 28.

When cap 28 is screwed down onto closure 26, cap 28 covers and protects rupturable membrane 27 during shipping and handling of container 12. Protrusion 108 further seals container 12 to insure against dangerous drips and spills from container 12 and to prevent atmospheric contamination of the contents. Groove 110 carries O-ring 56 which seals between cap 28 and closure 26.

Figure 4:
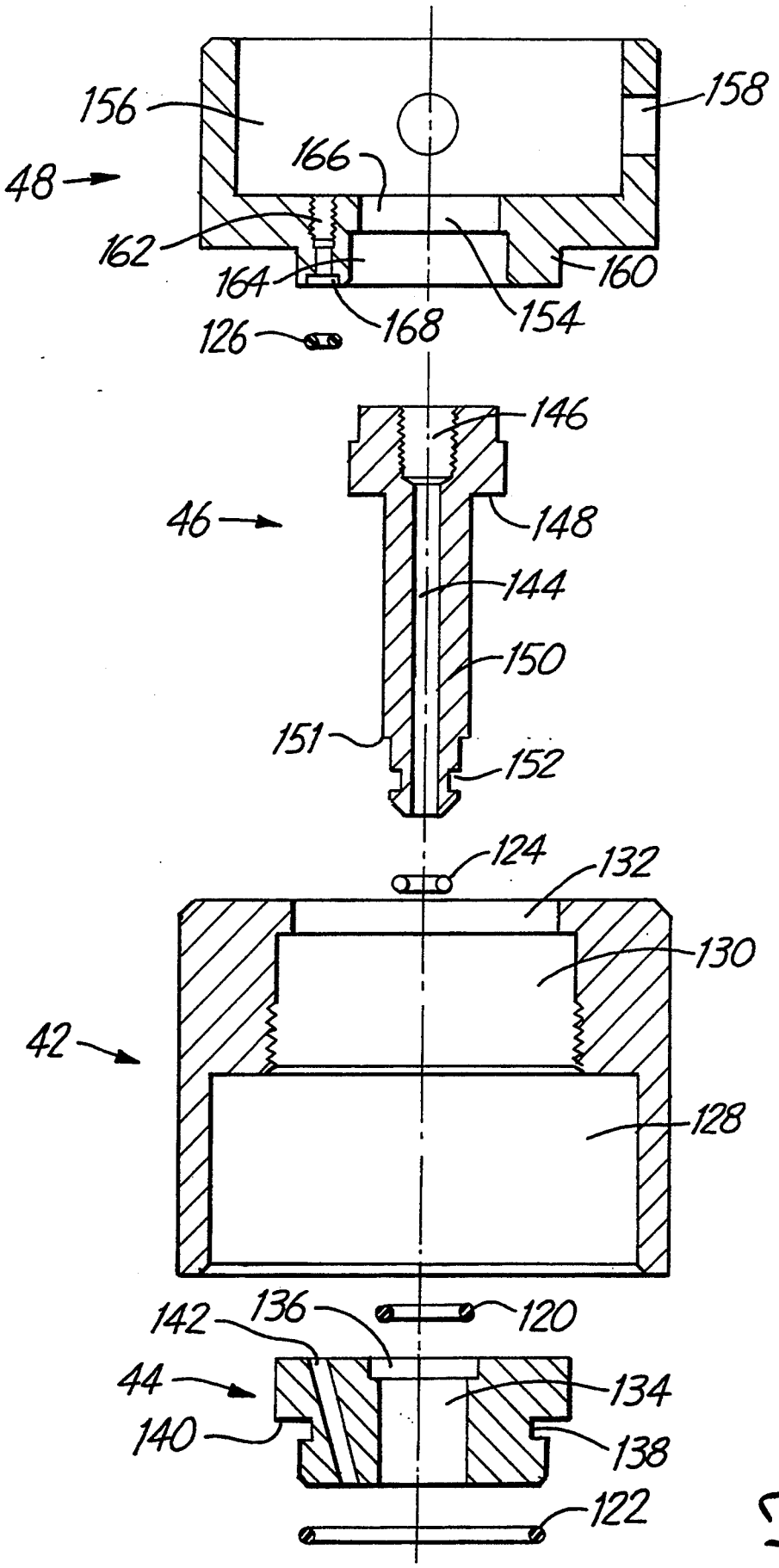
FIG. 4 is an exploded sectional view of the dispenser of the system of FIG. 1.
Figure 5:
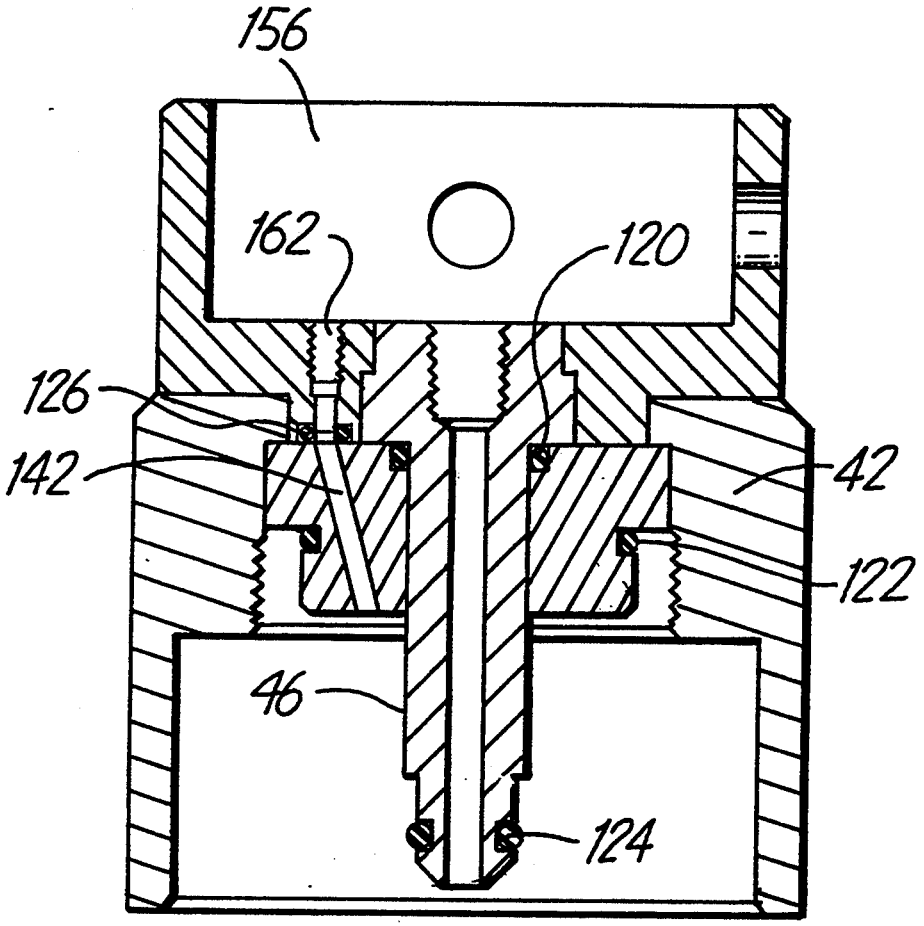
FIG. 5 is a sectional view of the assembled dispenser of FIGS. 1 and 4.

Dispenser 14 is shown in further detail in FIGS. 4 and 5. FIG. 4 shows an exploded sectional view of dispenser 14 and FIG. 5 shows an assembled sectional view of dispenser 14. Dispenser 14 includes lower connector 42, retainer 44, probe 46, upper connector 48, and O-rings 120, 122, 124, and 126. Lower connector 42 includes lower bore 128, middle bore 130, and top bore 132. Lower bore 128 is centered within a lower end of lower connector 42. Middle bore 130 is centered within lower connector 42 and above lower bore 128. Middle bore 130 is narrower than lower bore 128, has internal threads for engaging the external threads of closure 26, and has a diameter wide enough to enclose retainer 44. Top bore 132 is centered within a top end of lower connector 42. Top bore 132 is located above and is in communication with middle bore 130. Top bore 132 has a diameter large enough to couple with upper connector 48.

Retainer 44 nests within middle bore 130 of lower connector 42 and includes central bore 134, groove 136, groove 138, shoulder 140, and compression passage 142. Central bore 134 extends through a center of retainer 44. Groove 136 extends along an outer edge of a top end of central bore 134. Shoulder 140 extends along an outer surface of retainer 44 near a mid-point of retainer 44. Groove 138 extends along the outer surface of retainer 44 and is located below shoulder 140. Compression passage 142 is outside of central bore 134 and extends through retainer 44 from a top end to a bottom end of retainer 44.

Figure 6:
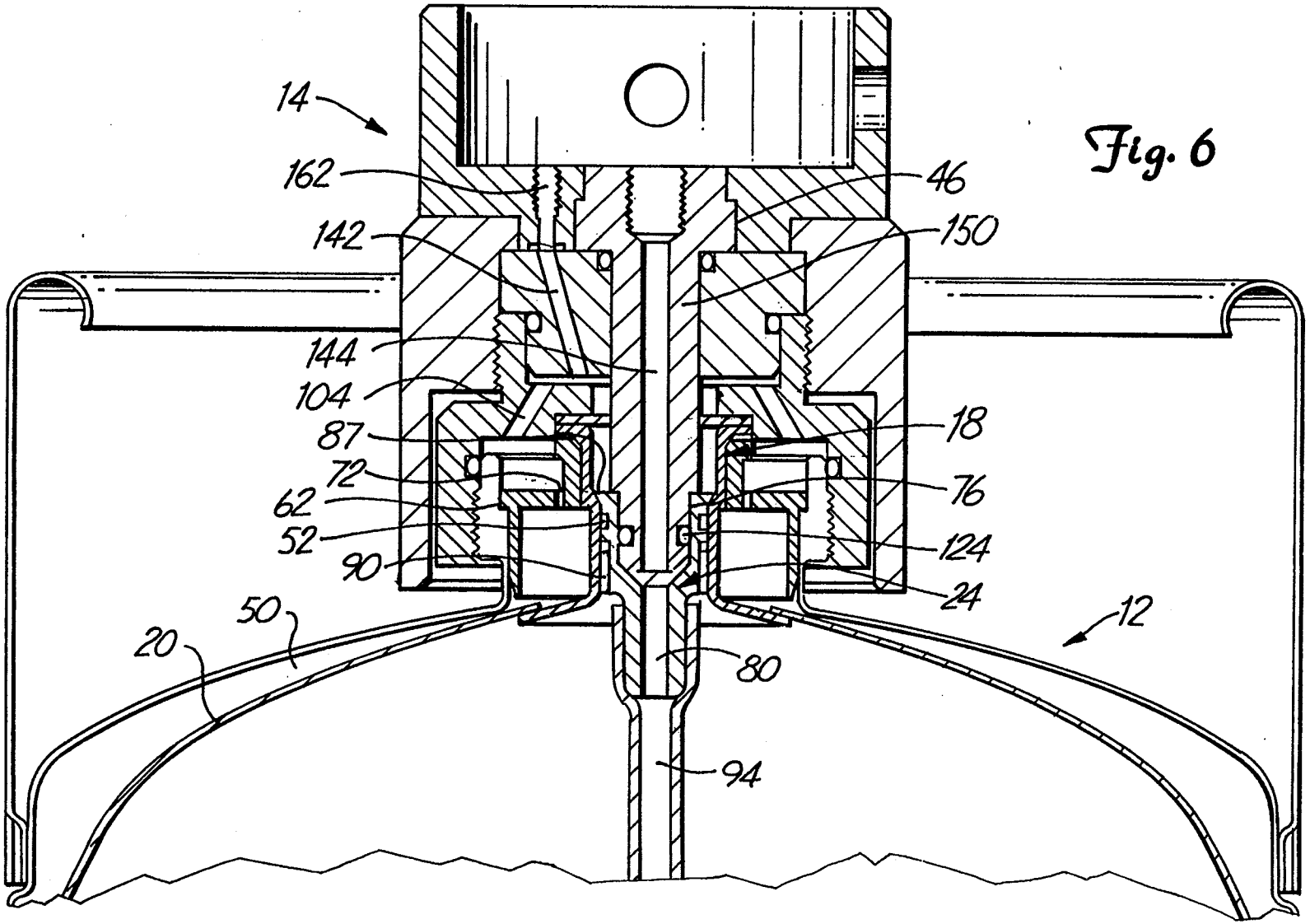
FIG. 6 is a sectional view of an upper end of the system of FIG. 1 showing the container and the dispenser assembled.

Probe 46 extends through central bore 134 of retainer 44 and is supported by retainer 44. Probe 46 includes flow passage 144, upper cavity 146, shoulder 148, shaft 150, shoulder 151 and groove 152. Upper cavity 146 is centered within a top end of probe 46 and has internal threads for engaging the external threads of a dispense point. Upper cavity 146 is in fluid communication with flow passage 144. Flow passage 144 is centered within probe 46 and extends from upper cavity 146 to a lower end of probe 46. Below the top end of probe 46, an outer surface of probe 46 narrows to form shoulder 148. Shaft 150 extends from below shoulder 148 to the lower end of probe 46. The lower end of probe 46 is pointed and has groove 152 which extends along an outer surface of shaft 150. O-ring 124 is carried by groove 152 and seals between probe 46 and cavity 76 of dip tube coupling 24 during the dispensing of liquid chemicals from container 12, as best shown in FIG. 6.

When dispenser 14 is assembled, as best shown in FIG. 5, shaft 150 of probe 46 extends through central bore 134 of retainer 44. Shoulder 148 of probe 46 rests upon the top end of retainer 44. O-ring 120 is carried by groove 136 and seals between shoulder 148 of probe 46 and the top end of retainer 44. Retainer 44, meanwhile, nests within middle bore 130 of lower connector 42, leaving the top end of probe 46 extending through and above top bore 132 of lower connector 42.

Upper connector 48 couples with retainer 44 and lower connector 42 to enclose probe 46. Upper connector 48 includes lower cavity 154, upper cavity 156, opening 158, protrusion 160, and compression conduit 162. Protrusion 160 protrudes from a bottom end of the upper connector 48 and has an outside diameter smaller than the inside diameter of the top bore 132 of lower connector 42. Upper cavity 156 is centered within a top end of upper connector 48. Opening 158 extends from upper cavity 156 through a side wall of upper connector 48. Lower cavity 154 is centered at a bottom end of upper connector 48 and extends from upper cavity 156 through protrusion 160. Lower cavity 154 has first and second inside diameters which mate with first and second outside diameters of the top end of probe 46, respectively. Compression conduit 162 is located to the outside of lower cavity 154 and extends from upper cavity 156 through protrusion 160 so that when dispenser 14 is assembled, as best shown in FIG. 5, compression conduit 162 is in fluid connection with compression passage 142 within retainer 44. Groove 168 is at a bottom end of compression conduit 162 and extends around an outer surface of compression conduit 162. The top end of compression conduit 162 has internal threads for engaging external threads of a source of fluid under pressure. Alternatively, when a pump is used to withdraw liquid chemical, compression conduit 162 vents air and connecting the source of fluid under pressure to conduit 162 may not be necessary.

When dispenser 14 is completely assembled, as shown in FIG. 5, O-ring 126, which is carried by groove 168, seals between upper connector 48 and retainer 44. Protrusion 160 of upper connector 48 fits within top bore 132 to couple upper connector 48 to lower connector 42 and retainer 44. The top end of probe 46 is enclosed between retainer 44 and upper connector 48; the top end of probe 46 fitting within lower cavity 154 of upper connector 48. A dispense point which extends through the opening 158 and which is screwed within upper cavity 146 of probe 46 is capable of receiving the liquid chemical when the liquid chemical is dispensed from container 12. Meanwhile, a compression fluid source may be screwed into compression conduit 162 to provide a fluid under pressure through compression conduit 162 and compression passage 142. Alternatively, compression conduit 162 and compression passage 142 can vent air when a pump is used to withdraw liquid chemical.

FIG. 6 shows dispenser 14 engaging container 12 with cap 28 removed during the dispensing of liquid chemical from container 12. To dispense liquid from container 12, cap 28 is removed and shaft 150 of probe 46 is inserted through upper bore 102 and through rupturable membrane 27 to release gas that has accumulated within fitment 18 and cavity 76 of dip tube coupling 24. Insertion of probe 46 continues until shoulder 151 of probe 46 forces dip tube coupling 24 further down into fitment 18 so that brim 87 rests on top of throat 62 of fitment 18. Upon full insertion of probe 46 into cavity 76, dip tube coupling 24 and its brim 87 block gas passage 90 to prevent any gas from escaping out of flexible bag 20 during the dispensing of liquid from container 12. O-ring 52 carried by dip tube coupling 24 is also forced further down into fitment 18 to seal between dip tube coupling 24 and fitment 18, thereby, also blocking gas passage 90. O-ring 124, meanwhile, seals between probe 46 and cavity 76 to prevent liquid chemical from flowing past probe 46 and to avoid dangerous chemical spills.

After probe 46 is fully inserted within cavity 76, fluid under pressure can be supplied into compression conduit 162 where the compression fluid, preferably compressed air or nitrogen, is allowed to flow through compression conduit 162, through compression passage 142, through compression passage 104, and into compression space 50. Once in compression space 50, the fluid under pressure will begin to collapse flexible bag 20 and force liquid chemical up through tube 94, through fluid passage 80, through flow passage 144, and out to dispense point. Alternatively, a pump connected to probe 46 can withdraw liquid chemical from flexible bag 20 of container 12. As liquid chemical is withdrawn from flexible bag 20, air is vented through compression conduit 162, through compression passage 104, and into compression space 50.

Figure 7:
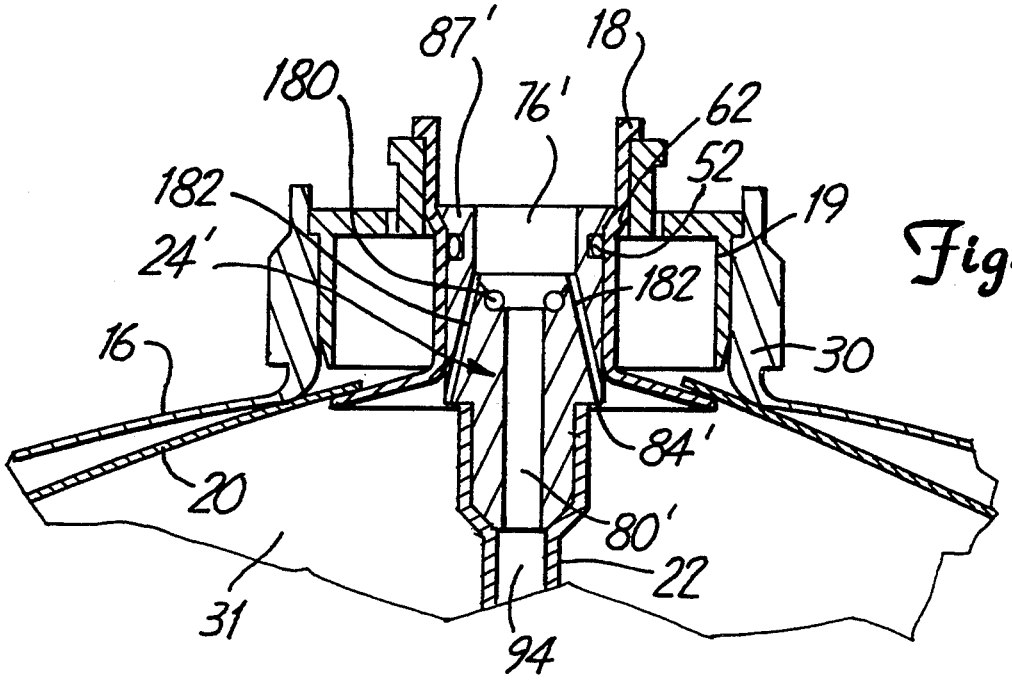
FIG. 7 is a sectional view of an alternative embodiment of a dip tube coupling.

FIG. 7 shows a sectional view of alternate embodiment 24 of dip tube coupling 24' resting within fitment 18. FIG. 7 also shows a sectional view of surrounding retainer 19, outer container 16, flexible bag 20, and dip tube 22. Dip tube coupling 24' includes cavity 76' fluid passage 80' shoulder 84' brim 87' and gas passages 182. Cavity 76' is centered within dip tube coupling 24' at its upper end and narrows toward a lower end of cavity 76' to communicate with fluid passage 80'. At lower end of cavity 76' O-ring 180 is carried and seals around end of probe 46 and dip tube coupling 24' when probe 46 is inserted into cavity 76' during dispensing of liquid chemical. Fluid passage 80' is centered within dip tube coupling 24' and extends from lower end of cavity 76' to a lower end of dip tube coupling 24'. Shoulder 84' is located near a mid-point of dip tube coupling 24' and is formed where an outer surface of dip tube coupling 24' narrows sharply inward. Brim 87' is formed at an upper end of dip tube coupling 24' where outer surface of dip tube coupling 24' protrudes outward. Gas passages 182 extend from cavity 76' through dip tube coupling 24' to a point above shoulder 84'. Gas passages 182 are in fluid communication with interior 31 of flexible bag 20.

Unlike gas passage 90 defined by dip tube coupling 24, gas passages 182 defined by dip tube coupling 24' extend through dip tube coupling 24'. Because gas passages 182 do not extend between fitment 18 and dip tube coupling 24' dip tube coupling 24' is completely fitted within fitment 18 immediately following filling of container 12 with chemical liquid. After flexible bag 20 is filled with liquid chemical, dip tube coupling 24' is inserted into fitment 18 such that brim 87' rests upon throat 62 of fitment 18. O-ring 52' carried below brim 87' seals between fitment 18 and dip tube coupling 24'. Although dip tube coupling 24' is completely adjacent to fitment 18, gas from interior 31 of flexible bag 20 is permitted to flow through gas passages 182 to accumulate within cavity 76'. As a result, gas is still permitted to escape from container 12 when a liquid chemical is dispensed from container 12. As with container 12 employing dip tube coupling 24, containers employing dip tube coupling 24' will also vent vapor pressure buildup within flexible bag 20.

Although the present invention has been described with reference to preferred embodiments, workers skilled in the art will recognize that changes may be made in form and detail without departing from the spirit and scope of the invention. For example, rupturable membrane 27 can be replaced by another form of seal, such as a plug or disk mounted on cap 28.

What is claimed is:

1. A container for liquid chemicals, the container comprising:

an outer container having a mouth;

a fluid container having a port and an interior;

means for supporting the fluid container within the outer container;

a dip tube having a fluid passage from an upper end to a lower end of the dip tube;

a dip tube coupling at the upper end of the dip tube for insertion into the port, the dip tube coupling having a cavity in its upper end which is connected to the fluid passage of the dip tube;

vent means intermediate the interior of the fluid container and the cavity for permitting gas flow between the interior of the fluid container and the cavity; and sealing means for sealing the cavity so that when the sealing means is removed, gas is permitted to escape from the fluid container.

2. The container of claim 1 wherein the sealing means is a break seal over a top end of the port.

3. The container of claim 2 wherein the break seal is mounted to a closure which encloses the port of the fluid container.

4. The container of claim 1 wherein the sealing means comprises a break seal over a top end of the port and a cap mounted over the port to cover the break seal.

5. The container of claim 2 wherein the break seal is a rupturable membrane.

6. The container of claim 1 wherein the means for supporting the fluid container comprises:

a fitment for mounting in the mouth, whereby the fitment defines the port; and wherein the fluid container comprises a flexible bag mounted to a lower end of the fitment and positioned within the outer container.

7. The container of claim 6 wherein the container further includes:

means in fluid communication with a space between inner walls of the outer container and the flexible bag for permitting fluid under pressure to flow into the space between inner walls of the outer container and the flexible bag to force liquid out of the flexible bag through the fluid passage in the dip tube.

8. The container of claim 7 wherewith means for permitting fluid under pressure to flow is a compression fluid passage which extends through the mouth of the outer container and is in fluid communication with the space between inner walls of the outer container and the flexible bag.

9. The container of claim 6 wherein the container further includes a retailer for mounting the fitment within the mouth of the outer container.

10. The container of claim 6 wherein the vent means is a gas passage extending from the interior of flexible bag through the dip tube coupling to the cavity of the dip tube coupling.

11. The container of claim 6 wherein the vent means is a spacing element positioned between the dip tube coupling and the fitment, whereby the spacing element spaces apart the dip tube coupling and the fitment to provide a gas passage extending from the interior of the flexible bag, between the dip tube coupling and the fitment, to the cavity of the dip tube coupling.

12. The container of claim 11 wherein the spacing element is an annular ring integral to an outer surface of the dip tube coupling and having means for permitting gas to flow past the annular ring.

13. The container of claim 12 wherein the means for permitting gas to flow is a notch in the annular ring.

14. A liquid chemical handling system comprising:

a container which comprises:

an outer container having a mouth;

a fluid container having a port and an interior;

means for supporting the fluid container within the outer container;

a dip tube having a fluid passage from an upper end to a lower end of the dip tube;

a dip tube coupling at the upper end of the dip tube for insertion into the port, the dip tube coupling having a cavity in its upper end, and a fluid passage connecting the cavity with the fluid passage of the dip tube;

vent means intermediate the interior of the fluid container and the cavity for permitting gas flow between the interior of the fluid container and the cavity; and a seal over the top end of the port so that when the seal is opened, gas is permitted to escape from the fluid container; and a dispenser which comprises:

a probe insertable through the rupturable seal and into the cavity, the probe having a flow passage therein; and means connected to the probe for receiving liquid chemical dispsened from the fluid container through the fluid passage of the dip tube, through the fluid passage of the dip tube coupling, and through the flow passage of the probe.

15. The system of claim 14 wherein the means for supporting the fluid container comprises:

a fitment for mounting in the mouth, whereby the fitment defines the port; and wherein the fluid container a flexible bag mounted to the lower end of the fitment and positioned with the outer container.

16. The system of claim 15 wherein the vent means is a gas passage extending from the interior of the flexible bag through the dip tube coupling to the cavity of the dip tube coupling.

17. The system of claim 15 wherein the vent means is a spacing element positioned between the dip tube coupling and the fitment, whereby the spacing element spaces apart the dip tube coupling and the fitment to provide a gas passage extending from the interior of the flexible bag, between the dip tube coupling and the fitment, to the cavity of the dip tube coupling.

18. The system of claim 17 wherein the spacing element is an annular ring integral to an outer surface of the dip tube coupling and having means for permitting gas to flow past the annular ring.

19. The system of claim 18 wherein the means for permitting gas to flow is a notch in the annular ring.

20. The system of claim 15 wherein the seal is a rupturable seal, and the fluid container further comprises a closure which is attached to the rupturable seal and which encloses the fitment and the mouth of the outer container.

21. The system of claim 20 wherein the probe is enclosed within a connector which is sized to mate with the closure.

22. The system of claim 15 wherein the dispenser further comprises:

means extending through the dispenser for supplying fluid under pressure between inner walls of the outer container and the flexible bag to collapse the flexible bag and to force liquid out of the bag through the fluid passage in the dip tube, through the fluid passage in the dip tube coupling, and through the flow passage in the probe.

23. The system of claim 15 wherein the dispenser includes an O-ring for sealing between the probe and the cavity.

24. The system of claim 15 wherein the fluid container further comprises:

means in fluid communication with a space between inner walls of the outer container and the flexible bag for permitting fluid under pressure to flow into the space between inner walls of the outer container and the flexible bag to force liquid out of the bag through the fluid passage in the dip tube and through the fluid passage in the dip tube coupling.

25. The system of claim 24 wherein the means for permitting fluid under pressure to flow is a compression fluid passage which extends through the mouth of the outer container and is in fluid communication with the space between inner walls of the outer container and the flexible bag.

26. A container for liquid chemicals, the container comprising:

an outer container having a mouth;

a fitment for mounting in the mouth, whereby the fitment defines a port;

a flexible bag mounted to a lower end of the fitment and positioned within the outer container;

a dip tube having a fluid passage from an upper end to a lower end of the dip tube;

a dip tube coupling at the upper end of the dip tube for insertion into the port, the dip tube coupling having a cavity in its upper end which is connected to the fluid passage of the dip tube;

vent means intermediate an interior of the flexible bag and the cavity for permitting gas flow between the interior of the fluid container and the cavity;

sealing means for sealing the cavity so that when the sealing means is removed, gas is permitted to escape from the cavity; and means in fluid communication with a space between inner walls of the outer container and the flexible bag for permitting fluid under pressure to flow into the space between the outer container and the flexible bag to force liquid out of the flexible bag through the fluid passage of the dip tube.

27. The container of claim 26 wherein the vent means is a spacing element positioned between the dip tube coupling and the fitment, whereby the spacing element spaces apart the dip tube coupling and the fitment to provide a gas passage extending from the interior of the flexible bag, between the dip tube coupling and the fitment, to the cavity of the dip tube coupling.

28. The container of claim 27 wherein the spacing element is an annular ring integral to an outer surface of the dip tube coupling and having means for permitting gas to flow past the annular ring.

29. The container of claim 28 wherein the means for permitting gas to flow is a notch in the annular ring.

30. The container of claim 26 wherein the means for permitting fluid under pressure to flow is a compression fluid passage which extends between the fitment and the mouth of the outer container.

31. The container of claim 26 wherein the sealing means is a break seal over a top end of the port.

* * * * *

UNITED STATES PATENT AND TRADEMARK OFFICE

CERTIFICATE OF CORRECTION

PATENT NO. : 5,335,821

DATED : August 9, 1994

INVENTOR(S) : MICHAEL L. OSGAR

It is certified that error appears in the above-indentified patent and that said Letters Patent is hereby corrected as shown below:

Col. 11, line 1, after "container", insert --comprises--

Signed and Sealed this

Twenty-fourth Day of January, 1995

*Attest:*

Bruce Lehman

BRUCE LEHMAN

*Attesting Officer*

*Commissioner of Patents and Trademarks*